US009816228B2

(12) United States Patent
Bueno et al.

(10) Patent No.: US 9,816,228 B2
(45) Date of Patent: Nov. 14, 2017

(54) CABLE AND METHOD FOR MANUFACTURING A SYNTHETIC CABLE

(71) Applicant: Braskem S.A., Camaçari (BR)

(72) Inventors: Marcos Roberto Paulino Bueno, Lauro Freitas (BR); André Penaquioni, Camaçari (BR)

(73) Assignee: Braskem S.A., Camacari—BA (BR)

( * ) Notice: Subject to any disclaimer, the term of this patent is extended or adjusted under 35 U.S.C. 154(b) by 54 days.

(21) Appl. No.: 14/908,207

(22) PCT Filed: Jul. 29, 2014

(86) PCT No.: PCT/BR2014/000255
§ 371 (c)(1),
(2) Date: Jan. 28, 2016

(87) PCT Pub. No.: WO2015/013790
PCT Pub. Date: Feb. 5, 2015

(65) Prior Publication Data

US 2016/0168786 A1 Jun. 16, 2016

Related U.S. Application Data

(60) Provisional application No. 61/859,436, filed on Jul. 29, 2013.

(51) Int. Cl.
*D07B 1/18* (2006.01)
*D07B 1/02* (2006.01)
(Continued)

(52) U.S. Cl.
CPC ..... *D07B 1/185* (2013.01); *D07B 1/02* (2013.01); *D07B 1/18* (2013.01); *D07B 3/00* (2013.01);
(Continued)

(58) Field of Classification Search
CPC ..... D07B 1/025; D07B 1/18; D07B 1/185; D07B 1/02; D07B 1/14; D07B 1/16;
(Continued)

(56) References Cited

U.S. PATENT DOCUMENTS 1,475,859 A * 11/1923 Nyman ..... B66C 1/12 248/61
2,561,487 A * 7/1951 Bailhe ..... B63B 21/20 114/230.26
(Continued)

FOREIGN PATENT DOCUMENTS

WO WO 2011/083126 A1 7/2011
WO WO 2012/139934 A1 10/2012

*Primary Examiner* — Ismael Izaguirre
(74) *Attorney, Agent, or Firm* — Duane Morris LLP

(57) ABSTRACT

The present invention relates to synthetic cables comprising core and splicing threads with high modulus threads, wherein the ends of the cable comprise looped or eyelet splice-type termination ends (1), and wherein each leg of the parallel splicing threads (13, 13') is connected to parallel core threads (21) at an interpenetration region (12). The method comprises individually connecting each leg of the splicing threads (13) with a positive splice to a core thread(s) (21) of the beginning end of the cable (2); looping; straining all the threads and applying a normal compression force at the interpenetration region (12); applying a protective element(s) (32) along the cable and further individually connecting each leg of the splicing threads (21) to form a negative splice to a core thread(s) (21) of the final end of the cable core (2); and looping, straining and applying a normal compression force (12) on the negative splice at the interpenetration region.

12 Claims, 8 Drawing Sheets

(51) Int. Cl.

| | |
|---|---|
| ***D07B 7/16*** | (2006.01) |
| ***D07B 9/00*** | (2006.01) |
| ***D07B 3/00*** | (2006.01) |
| ***D07B 5/00*** | (2006.01) |

(52) U.S. Cl.

CPC ..... *D07B 5/00* (2013.01); *D07B 7/16* (2013.01); *D07B 7/169* (2015.07); *D07B 9/00* (2013.01); *D07B 1/025* (2013.01); *D07B 5/002* (2013.01); *D07B 2201/2033* (2013.01); *D07B 2201/2034* (2013.01); *D07B 2201/2098* (2013.01)

(58) Field of Classification Search

CPC . D07B 1/162; D07B 9/00; D07B 7/16; D07B 7/169; D07B 3/00; D07B 5/00; D07B 5/002; D07B 2201/2033; D07B 2201/2034; D07B 2201/2098

See application file for complete search history.

(56) References Cited

U.S. PATENT DOCUMENTS

| | | | | |
|---|---|---|---|---|
| 2,981,053 | A * | 4/1961 | Harrison | B24D 13/14 124/23.1 |
| 3,122,806 | A * | 3/1964 | Lewis | B66C 1/12 174/79 |
| 3,899,206 | A | 8/1975 | Miura | |
| 4,534,163 | A | 8/1985 | Schuerch | |
| 5,136,755 | A | 8/1992 | Shaw | |
| 5,540,703 | A * | 7/1996 | Barker, Jr. | A61L 17/04 289/1.2 |
| 6,253,754 | B1 * | 7/2001 | Ward | F41B 5/14 124/90 |
| 6,585,842 | B1 * | 7/2003 | Bompard | B29C 70/202 156/166 |
| 2013/0205742 | A1 * | 8/2013 | Smeets | D07B 1/0686 57/212 |
| 2014/0212213 | A1 * | 7/2014 | Meyers | F16B 7/0433 403/396 |

* cited by examiner

CABLE AND METHOD FOR MANUFACTURING A SYNTHETIC CABLE

CROSS-REFERENCE TO RELATED PATENT APPLICATIONS

The present application is a U.S. national stage application under 35 U.S.C. §371 of PCT Application No. PCT/BR2014/000255, filed Jul. 29, 2014, which claims priority to U.S. Provisional Patent Application No. 61/859,436, filed Jul. 29, 2013, the entireties of which are incorporated herein by reference.

TECHNICAL FIELD

The present invention relates to a cable comprising a core formed by high modulus threads arranged in parallel and connected to a splice-type termination end.

DESCRIPTION OF THE STATE OF THE ART

The history of oil and gas exploitation in offshore reservoirs has been accompanied by extensive technological development since deeper waters are being exploited. Replacement of steel cables with synthetic wires that has occurred during the 90's has enabled an advancement into deep and ultra deep waters. Discovery of new reservoirs in pre-salt layers as reported by Petrobras in 2006, has given Brazil an important role in the world market, changing the International energy matrix. However, technical and logistic difficulties associated with the depth and distance from the shore has brought new technological challenges.

Aspects such as difficulty in the transportation of anchorage lines, the environmental forces involved and the need for a strict restriction of the anchorage radius have motivated the oil industry to exploit the use of new materials in anchorage lines which so far only relied upon the good performance of polyester. High modulus threads such as Aramid, Vectran, Polyethylene Naphthalate (PEN) and High Modulus Polyethylene (HMPE) are then being studied by different manufacturers and research centers for the purpose of increasing the performance thereof, as well as reducing the transportation and installation costs of anchorage lines.

Although said materials have greater performance than polyester, the use of classical construction technologies currently used by thread industries has resulted in low efficiency on the cables, which is aggravated by the increased diameter that is proportional to the maximum break load (MBL). The low efficiency related to the construction aspects from the state of the art requires the use of a larger amount of threads for an intended MBL to be achieved, reducing the price competition of these materials over the use of polyester.

As is widely known, efficiency is the cable's ability to convert the strength of the thread into the strength of the cable. One way to express it is the percentage strength loss by the linear density of the cable over the resistance per unit of the linear density of the threads comprising it. Today, with the advancement in construction technology, efficiency values of about 90% have been achieved for cables made of polyester, even in products of high MBL.

Low efficiency of cables manufactured with high modulus threads can be explained by three main aspects. The first one is related with the reduction in the strength of the threads due to high wear and loss of material on the walls of the filaments during the production process of the cable.

The second aspect is related to the traditional manufacturing technology of splices used in the state of the art, where hand manufacture is used. Where "hand" is a term used in the industry referring to the stitching of the splice on the cable body. This operation also implies several problems in aligning and controlling the stress of threads on the seam or splice.

The last aspect related to the construction technology currently used for ultra-high performance cables, wherein the thread elongation (~4%) is extremely low as compared to that of polyester (~14%), for example. High modulus threads are capable of supporting an extremely high local load due to the difference in mobility between different regions of the cable.

Intrinsically, the two latter aspects explaining the low efficiency of cables made of high modulus threads are interrelated with each other, wherein these aspects have as the main cause the low elongation of high modulus threads resulting in an intolerance to local mobility differences. That is, the different paths among the thousands of threads jeopardize mobility thereof, overloading regions of the cable during tensile assays or use under extreme situations. This effect is even worse in the regions were splices are seamed and therefore on these regions there is a probability for the cable to break.

Based on this, the more parallel and adjusted the threads inside the cable, the greater the efficiency thereof.

From among the known construction structures, the parallel construction (Parafil) would be the most suitable for high modulus threads. However, with the technology known from the state of the art the construction in parallel precludes the use of splice-type terminations, as the hand seaming of the splice threads to the cable body is practically impossible.

From among the alternative options to the splice in the cable terminal, as known from the state of the art, are the mechanical clamp and the socket. However, for cables of high MBL (used in applications of production platforms and offshore drilling rigs, for example, the tensile strength ranges from 600 to 1250 tf), the local stresses between the cable body and the terminations are huge, and in this case, using a mechanical clamp is certainly not possible. This is related to an important aspect of the mechanics of terminations, since while the breaking strength varies with the cross-sectional area of the cable (second potency of the diameter), the "clamping" strength of the ends in scale with the circumference of the cable (first potency of the diameter). That is, unless the connection can be made homogeneously over the entire cross section area surface of the cable, it is much harder to obtain an effective terminal in cables of high diameter as compared to those of low diameter.

Therefore, based on this reasoning, the use of sockets would theoretically be a good option, since in this type of terminal voltage is transferred throughout the entire cross-sectional area of the core. However, in practice, when high MBL values are being obtained, sockets become inefficient, considering that in this type of terminal a few millimeters of filament-resin interaction are needed for the adhesion strength to overcome the thread breaking strength as widely known, and also reported by Mckenna, 2004. Since sockets are generally mounted with non-stressed threads, a gradual reduction in the filament's diameter, which is proportional to the elongation occurs, when the load is transferred along the cable. The result is the gradual detachment of the thread-resin interface resulting in local stress concentration and consequent breakage of the filaments.

Document U.S. Pat. No. 3,899,206 describes a construction structure wherein yarns are mounted in overlapping layers of a conceptually endless shape, terminations are formed by the cable body constituting a single body, with a low probability for defects. However, the disadvantage of this type of structure is that the cable body has twice the number of yarns than its terminations. That is, the greater likelihood of fracture is on the terminations, which makes it impossible to be used on very high load applications, as is the case of for example of anchorage cables.

Documents U.S. Pat. No. 3,899,206 and U.S. Pat. No. 4,534,163 describe cable structures with a parallel construction and their respective manufacture processes. However, these documents do not describe how to manufacture the terminations.

The parallel construction technology developed for the construction of high rupture load cables for the purposes of anchoring platforms has been used in the mid 60's and was designated Parafil Rope. Nevertheless, as mentioned before, a problematic aspect of this technology is how the termination ends are connected. It refers to a metallic clamp where a conical insert spreads the yarns surrounded by an external connector. In this type of device, the clamping strength is proportional to the tensile strength exerted onto the cable. Connections self-adjust by the strength, ensuring an effective transfer of tension to the eyelets. In this regard, patent document U.S. Pat. No. 5,136,755 describes a device that acts similarly, having good performance when high modulus threads are used. However, since the tensile strength of the cable is mainly in the form of shear and compression forces onto yarns of the ends, the lower the thread strength in the crosswise direction, the worse the performance of this type of device.

An example is the HMPE thread which has an Young's modulus and a tensile strength comparable to a steel cable; however, this type of thread has low shear strength and transverse compression. Therefore, using this type of device in high modulus threads would not result in good efficiency, especially when high failure load (or high MBL) cables are to be manufactured.

Document WO 2011/083126 describes a hybrid cable of synthetic thread and steel cable, having a structure comprising a body formed of a core of synthetic threads surrounded by an outer layer of steel cable. The document further describes a termination end formed by a conical socket, wherein the synthetic threads of the core as well as the filaments of the steel yarn are connected together and attached to the socket by means of a resin. However, the document does not disclose results on the efficiency of the tested cables. In the examples, only comparative results between socket clamping and clamping with the clamps of a traction machine are presented. Another important issue related to this document is the applicability of such hybrid construction when using steel and HMPE.

HMPE has a more pronounced flowability problem as compared to other synthetic yarns. Thus, even with recent advances in this respect (as shown in patent document WO 2012/139934), such a problem would make long term applications impossible—which is the case of oil platforms anchorage. Since flowability in HMPE threads, even if low, is higher than that of steel threads. While synthetic threads would relax under stress, steel threads would not. The tensile strength would cause the steel threads to overload with time and under an extreme condition (as is the case of a severe storm), the structure would probably collapse.

OBJECTS OF THE INVENTION

The object of the present invention is to provide a cable comprising a core formed by high modulus threads arranged in parallel and connected to a splice type termination end, where the MBL of the splice is equivalent, or greater than the MBL of the cable.

Another object of the present invention is to provide a method for connecting a cable comprising a core containing high modulus threads that are arranged in parallel to a splice-type termination end for achieving the above goal.

BRIEF DESCRIPTION OF THE INVENTION

In order to achieve the aforementioned objects, the present invention provides a synthetic cable comprising a core formed of high modulus threads arranged in parallel, wherein the ends of the cable comprise splice-type termination ends, wherein each splice comprises high modulus threads arranged in parallel forming an eyelet on each splice, wherein each leg of the threads comprising each splice is connected to a thread that forms the core of the cable, wherein the splice threads and the core threads are arranged in parallel at an interpenetration region.

The present invention further provides a method for manufacturing a synthetic cable comprising a core formed of high modulus threads arranged in parallel to each other, wherein the ends of the cable comprise splice-type termination ends, wherein each splice comprises high modulus threads arranged in parallel to each other, which method comprises the steps of: individually connecting each leg of the threads comprising a positive splice to a thread of the beginning end of the cable core forming a loop; joining the threads of the positive splice so as to form a loop, straining all the threads, wherein the splice threads and the core threads are arranged in parallel to each other at an interpenetration region; applying a normal compression force at the interpenetration region of the positive splice; applying at least one protective element along the entire length of the cable; individually connecting each leg of the threads that form a negative splice to a thread of the final end of the cable core forming a loop; joining the threads of the positive splice so as to form a loop, straining all the threads, wherein threads from the splice and threads from the core are arranged in parallel to each other at an interpenetration region; and applying a normal compression force at the interpenetration region of the negative splice.

DESCRIPTION OF THE FIGURES

The following detailed description makes reference to the accompanying drawings, in which.

DETAILED DESCRIPTION OF THE INVENTION

Figure 1:
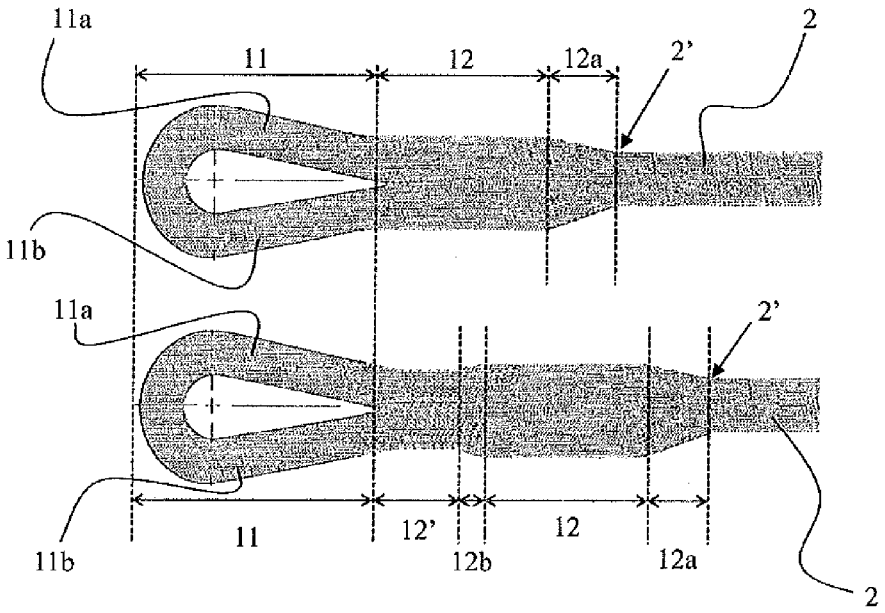
FIG. 1 illustrates an schematic view of two embodiments of splices, in accordance with the present invention.

The following description will be based on a preferred embodiment of the invention. As will be evident to the skilled person, however, the invention is not restricted to this particular embodiment.

The present invention is directed to a cable 2 containing a core where threads 21 are arranged in a single bundle of parallel structure connected to a splice 1 by a region, referred to as interpenetration region 12, where the splice threads 13,13' and the core threads 21 are arranged in parallel to each other.

The cable 2 disclosed herein is ideal for applications that require an optimum relationship between MBL and efficiency as is the case of the use of offshore anchorage lines. The performance thereof in applications with high level of mechanical requirements provides significant potential gains also in terms of transportation logistics and cost of installation, in addition to allowing the potential reduction in the number of anchorage lines, enabling a potential increase of the yield of oil fields where submarine anchorage spots may be jammed, if anchorage lines of low rigidity cables continue to be used.

FIG. 1 illustrates a splice termination end 1 of a cable in accordance with an optional embodiment of the present invention, wherein the splice 1 has two main regions: the eyelet region 11 and the interpenetration region 12. Continuity of the splice 1 is formed by the core threads of the cable 2.

In more detail, the splice illustrated in FIG. 1*a* comprises a first region that forms the eyelets 11, where the bundle of splice threads distributes into two bundles 11*a*, 11*b* that advance to the cylindrical interpenetration region 12, which comprises a diameter that is greater than the diameter of the cable 2. Also, between the cylindrical interpenetration region 12 and the cable 2, a descending interpenetration region 12*a* is formed until the assembly achieves the thickness of the cable 2.

As illustrated in FIG. 1*b*, between the region of the eyelets 11 and the cylindrical interpenetration region 12, the splice alternatively comprises a region referred to herein as neck 12' of the splice if one needs to displace the cylindrical interpenetration region 12 away from the eyelet region 11, for example, due to requiring a lower total diameter at that region. In this configuration, therefore, the splice comprises a cylindrical interpenetration region 12, an ascending interpenetration region 12*b* and a descending interpenetration region 12*a*.

The cylindrical interpenetration region 12 comprises segments of splice threads 1 having exactly the same size over its entire length. Said in another way, considering an imaginary roll, the ratio of the number of splice threads 1 to the number of core threads of the cable 2 is constant over the entire cross-section area along such region.

In turn, the descending interpenetration region 12*a* comprises a concentric reduction of the number of splice threads over the core threads, along the region starting at the cylindrical interpenetration region 12 and finishing at point 2' wherein the splice has the same diameter as the cable. From there, cable 2 only comprises the core threads.

Finally, the ascending interpenetration region 12*b* comprises a concentric increase in the number of core threads over splice threads 1 along the region that initiates at the neck region 12' of the splice and finishes at the cylindrical interpenetration region 12.

From a structural point of view, the interpenetration region 12 acts to transfer tension from the eyelet region 11 to the cable body 2, wherein, in accordance with the present invention, said tension transfer is made thread by thread, as will be explained in more detail below.

With the construction proposed by the present invention, it is possible to improve efficiency of said transfer such that the failure strength of these splice-type terminations 1 is higher than the failure strength of the segment of the cable body 2, hence increasing its efficiency.

There are basically seven basic functions that can be manipulated for this goal to be achieved, namely: the function of the length of the splice threads; the number of windings per meter of splice threads with the core threads; the normal compression force; the connection strength and position of the junction points of the splice threads in the core threads; the number of splice threads to the number of core threads; and the titer and the type of splice threads.

The function of the length of the splice threads 1 involves the interpenetration ratio, that is, the ratio of the length of the splice thread segment 13,13' to the length of the core thread 21 of the cable. For symmetry reasons, said ratio ranges in the concentric layers of the cable 2. The greater this ratio, the greater the size of the contact segment between the splice threads 13,13' and the threads 21 of the core of the cable 2. Since there is a discontinuity between the splice threads 13,13' and the core threads of the cable, the strength of this union is dependent upon the contact area between these threads in the splice segment. In addition, the function of the length of splice threads 13,13' as well dictates the geometry of the interpenetration region.

By changing the length of the splice threads 13,13' in the concentric layers of the cross section area we can define the length of the cylindrical region, as well as the geometry and the rate of reduction or rate of increase in the diameter in regions of descending and ascending diameter, respectively. For example, by manipulating this function one can build a geometry of reduced or increased diameter, which goes from conical to hyperbolic. That is, by a simple process parameter one can manipulate an essential aspect of the fracture mechanics which is the geometry of the tension flow lines along a body.

As will be better described below, the manufacture process of the splice 1 disclosed herein, in an optional configuration, allows for a winding of the splice thread 1 to be made surrounding the thread of the core of the cable 2, along the interpenetration region. The helical path can also alternate into S and Z along the concentric layers of the cross-section area of this region. Therefore, the helix angle or, in other words, the number of turns per meter of cable 2 in this region is another variable that can be manipulated to potentiate the connection strength of this region.

Figure 2:
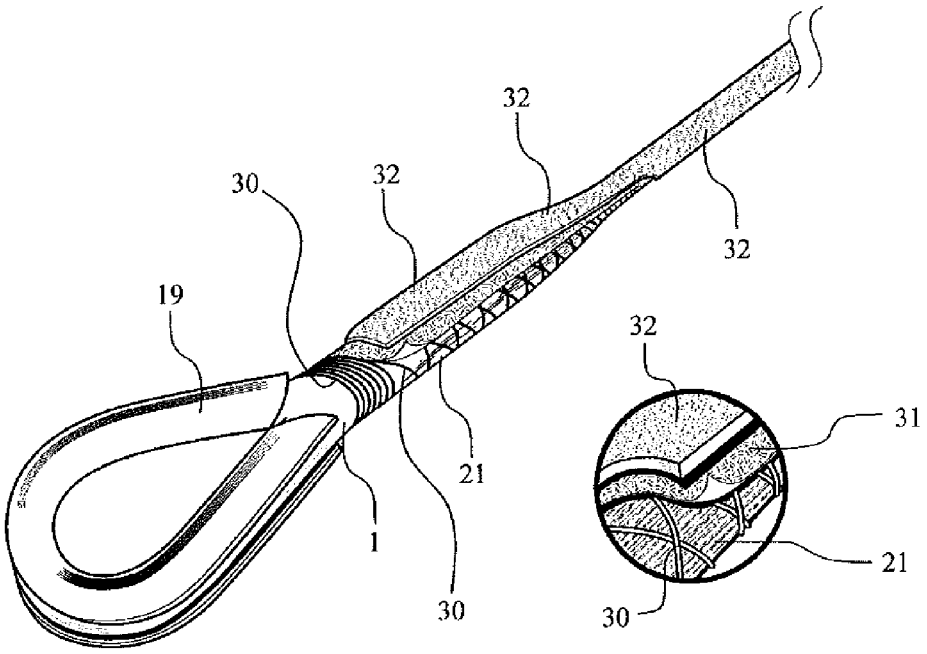
FIG. 2 shows a perspective view of a particular embodiment of the present invention.

FIG. 2 illustrates an optional embodiment of the splice of the present invention, wherein in order to increase the cohesive force of the interpenetration region an application means of a normal compression force is present in this region. Such a force is optionally exerted by outer tightening threads 30 and, still optionally, it is potentiated with any other reinforcing element 31 known from the state of the art, as will be better discussed below.

In this embodiment, the compression force is the function of a series of variables, such as the tightening strength of the outer tightening threads, the number of outer tightening threads and the helix angle of the threads along the entire interpenetration region.

Optionally, the present invention also discloses the possibility of using additional reinforcements in the interpenetration region 12 in order to increase the compression force on that site (not illustrated). To that end, other solutions found in the state of the art are used, such as for example ribbons or screens, which can be spiral- or belt-wound, or even any adhesion element that maintains it attached during the entire shelf life of the cable 2.

Optionally, The present invention also discloses the use of protective elements to the cable 32. Many protective elements or covers found in the state of the art can be used, such as woven covers. Nevertheless, the use of an extruded cover made by the pull extrusion process is preferred.

Still optionally, the present invention discloses the possibility of using different protective elements along the cable segments. As illustrated in FIG. 2, a segment of the cover that is more reinforced at the interpenetration region 31 is preferably used, since protection of the structural elements contained at said region is more critical over other segments of the cable, as this is the region where the splice threads 13,13' are connected to the cable threads 2.

Still optionally, the eyelet region receives an extra protection in the end of the production of the cable or coupled by the user prior to installation, which is referred to as thimble 19. The thimble 19 is a high wear-resistant metallic part commonly used for protecting splice threads of the termination ends. Alternately, the thimble can be made of any other intended material.

Figure 3A:
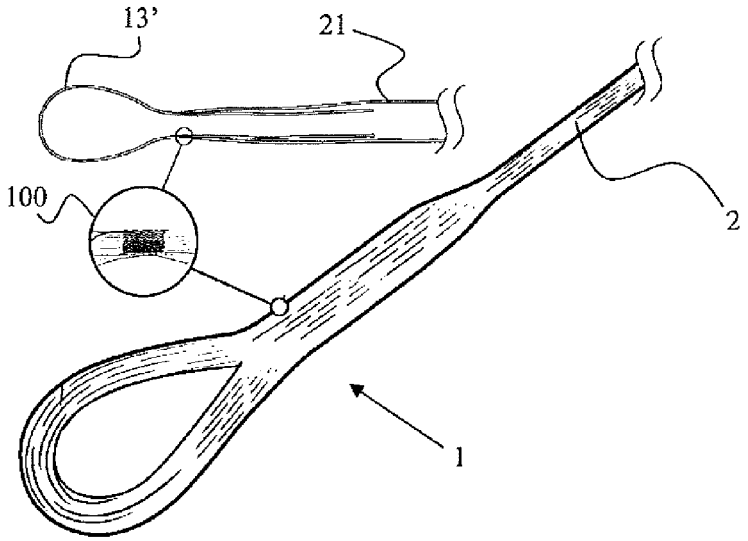
FIG. 3*a* illustrates a particular embodiment of a positive splice in accordance with the present invention.
Figure 3B:
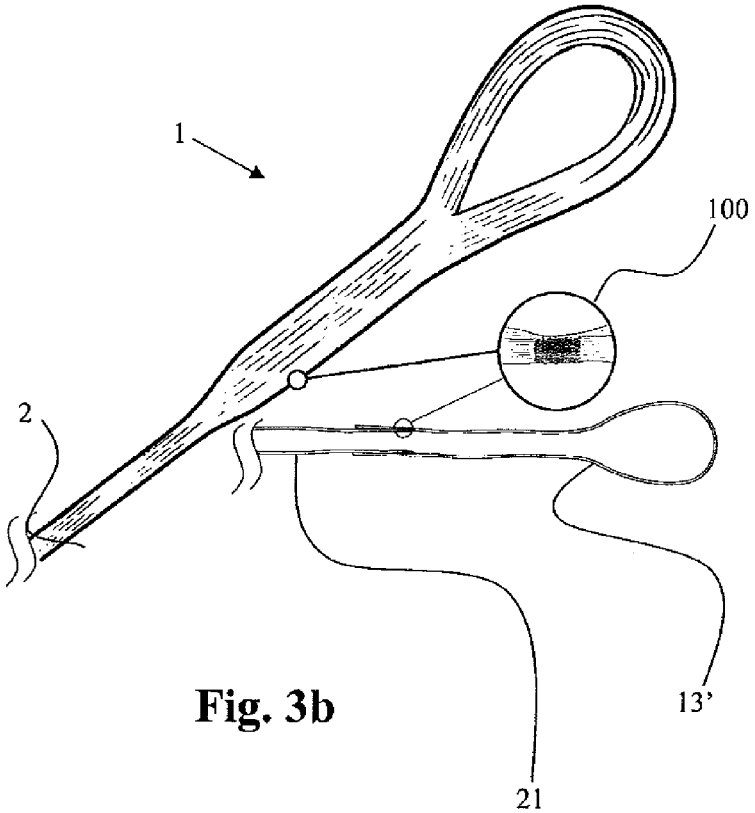
FIG. 3*b* illustrates a particular embodiment of a negative splice in accordance with the present invention.

FIGS. 3*a* and 3*b* illustrate both termination ends of a cable in accordance with the present invention, wherein one can clearly note the presence of connection entanglement points 100 between the splice threads 13 and the threads 21 of the cable core.

FIG. 3*a* illustrates the positive splice (initially formed) in accordance with the present invention, wherein positions of the termination connection points are closer to the eyelets 11 because in the beginning of the assembly operation, the threads 13 of the positive splice pull the core threads 21 (said process will be explained in more detail below).

FIG. 3*b* in turn illustrates the splice 1 formed in accordance with the present invention, which is referred to as negative splice, wherein, in contrast to the positive splice (FIG. 3*a*), connection points 100 are located far away from the eyelets 11.

In accordance with this optional configuration of the present invention, connection between the threads 13 of the splice with the threads 21 of the core of the cable is made by means of suitable devices for providing an efficient point connection between the two threads (splice threads 13 and core threads 21) at the filament level. The manner by which these threads are connected will be better discussed below.

The thread by thread connection, which was described earlier and will be more fully described later, between the cable and the splice distinguishes the present invention from cables with splices known in the art, among other features, as to the number of splice threads over the number of core threads. According to the invention proposed herein, this is a free ratio such that the number of splice threads 1 can be manipulated so that the resistance of the splice bundle 1 is greater than the failure resistance of the bundle of core threads 21 of the cable 2.

Besides the number of threads, the titer of the threads used in splice 1 is also a free variable that can be manipulated for one to obtain the desired resistance to the bundle of threads that surround the splice eyelets 11.

The ratio of the number of threads and the titer is a function of the tenacity of the threads comprising the cable, and can be expressed by the following equation:

$$F_R^S = n * D_0 * T$$

wherein:

n is the relative number of splice threads for each core thread, $D_0$ is the titer of the individual thread, in dtex, and T is the tenacity of the individual thread, in cN/dtex.

The failure strength of the thread of the bundle of splice threads in cN for each core thread is given by FSR IMAGEM.

Therefore, the intrinsic criterion related to the failure strength of the bundle or the splice thread relative to each core thread is given by equation 2:

$$F_R^S \geq F_R^C$$

wherein:

$F_R^C$ is the failure strength, in cN, of the core thread.

Another advantage of the cable of the present invention as compared with the state of the art is the possibility of using different types of high performance threads to build the splice 1 relative to the threads used in the construction of the cable core 2. The present invention also provides the possibility of choosing a hybrid bundle, where a mixture of threads can be made at any intended ratio.

Regarding the type of thread to be used, the present invention provides the use of any thread of any material commonly used in the thread industry or materials that may be developed in the future. Such that the threads are preferably but not restricted to: nylon 6,6 (poly(hexamethylenediamine)); nylon 6 (poly (4-aminobutyric acid)); polyesters, e.g., PET (poly (ethylene terephthalate)), PEN (polyethylene naphthalate); PBN (poly (butylene terephthalate)); poly (1,4-hexylene dimethylene teraphthalate); polyvinyl alcohols, glass fibers, steel wires; polyolefin fibers; polypropylene homopolymers and co-polymers, co-polymers.

Further, the present invention also discloses the use of high performance threads, but is not restricted to them, as follows: high modulus polyethylene fibres (HMPE); Kevlar® (poly (p-phenylene teraphthalate)); PTFE (politetrafluoretileno); Technora® (aromatic copolyamide (co-poly-(paraphenylene/3,4'-oxydiphenylene terephthalamide))); M5 (poly{2,6-di-imidazo-[4,5 b-4',5'E]pyridinylene-1,4(2,5-di-hydroxy)phenylene}); Zylon®, PBO (poly(p-phenylene-2,6-benzobisoxazole); LCP (polymers of thermotropic liquid crystals), carbon fibers. Preferably, high performance fibers as used such as HMPE (high modulus polyethylene fibers); Kevlar® (poly (p-phenylene terephthalamide)); LCP (polymers of thermotropic liquid crystals) and PEN (polyethylene naphthalate), and more preferably HMPE (high modulus polyethylene fibers).

In context of the present invention, high performance threads are characterized by having tenacity, as measured in accordance with the method based on Rule ISO 2062, of greater than 15 cN/dtex, preferably greater than 20 cN/dtex, or of at least 30 cN/dtex.

Still in context of the present invention, high performance threads are further characterized by having an elastic modulus, as measured in accordance with the method based on Rule ISO 2062, of greater than 500 cN/dtex, preferably greater than 800 cN/dtex, or more preferably greater than 1250 cN/dtex.

In addition to multifilament-containing threads, other solutions can be used as well such as, for example, monofilament threads, ribbons and films cut in the shape of a ribbon.

Just like with the cable core threads 21 of the present invention, the use of various types of high performance threads in the external tightening of the splice as well as a mixture of threads at any intended ratio is provided. As to the types of threads the following examples may be cited, but not restricted to, nylon 6,6 (poly (hexamethylene-adipamide)); nylon 6 (poly (4-aminobutyric acid)); polyesters, e.g., PET (poly (ethylene terephthalate)), PEN (polyethylene naphthalate); PBN (poly (butylene terephthalate)); poly(1,4 cyclohexilidene dimethylene teraphthalate); polyvinyl alcohols, glass fiber, steel wires; polyolefin fibers; polypropylene homopolymers and co-polymers, co-polymers. High performance threads can be used, but not restricted to the same, wherein high modulus polyethylene fibers (HMPE); Kevlar® (poly (p-phenylene-terephthalamide)); PTFE (poly (tetrafluoroethylene)); Technora® (aromatic copolyamide (co-poly-(paraphenylene/3,4'-oxidiphenylene terephthalamide))); M5 (poly{2,6-di-imidazo-[4,5b-4,5E]pyridinylene-1,4(2,5-di-hydroxy)phenylene}); Zylon®, PBO (poly(p-phenylene-2,6-benzobisoxazole); LCP (polymers of thermotropic liquid crystals), carbon fibers can be mentioned. Preferably, high performance fibers such as HMPE (high modulus polyethylene fibers); Kevlar® (poly (p-phenylene terephthalamide)); LCP (polymers of thermotropic liquid crystals) and PEN (polyethylene naphthalate) may be used. More preferably, HMPE (high modulus polyethylene fibers) can be used.

Optionally, the present invention provides the use of any surface finishing liquid, such as coatings, ensimage oil or any fluid having protective function, processability or that improves the performance of the thread in the splice. Also, the present invention contemplates the use of any type of coating or adhesive that improves the attachment strength of the threads at the interpenetration region of the splices with the core threads 21, provided that it does not affect the performance of the attachment due to a local concentration of stress in the "bedding in" step (adjustment of the cable) which in turn is carried out at the installation step, when the cable is used in Offshore anchorage applications. In this step, it is important that some degree of mobility is present for a better fit of the threads or a better alignment of the threads along the cable be obtained.

It is important to note that the bundle of core threads 21 of the cable forms the main structural member of the cable, as disclosed by the present invention, wherein the threads comprising it are arranged in parallel to each other. Cables containing a core where the threads are arranged in parallel to each other are known from the state of the art. Nevertheless, the difference between the cable disclosed herein and the prior-art cables is the use of splice-type termination ends in a cable containing a single bundle core.

Figure 4:
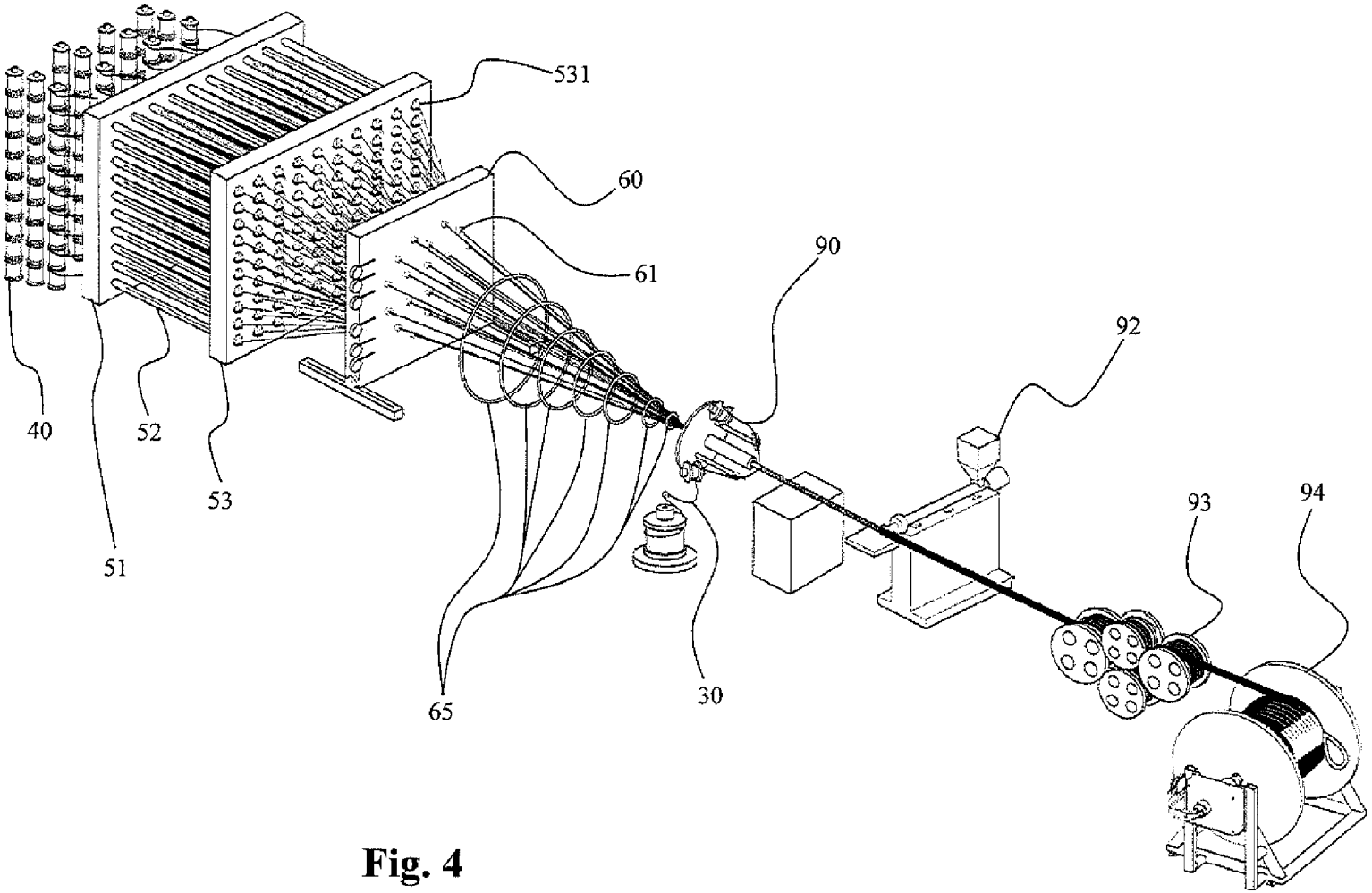
FIG. 4 illustrates the process for producing the cable and the splice in accordance with a particular embodiment of the present invention.

FIG. 4 illustrates the process for producing the cable 2 and the splice 1 of the present invention, which is performed in five units:

unit of storage of core threads 21;

unit of accumulation of splice threads;

unit of self-assembly of the splice threads in the core threads 21;

unit of assembly of reinforcement and cover members of the splices; e winding unit.

The unit of storage of core threads is the unit where threads which will comprise the bundle of core threads of the cable are mounted and stored. In this particular and optional embodiment, the threads are stored in spools 40 arranged on supports commonly known as "cages". However, any and all support found in the state of the art can be used to that end, such as frames, cages or beams such that its alignment is in the axial direction of manufacture of the cable 2, towards the vacuum drawdown grid 51 (which will be described below).

For a matter of space, unlike the optional configuration illustrated herein, storage in beams is chosen. The core thread can contain the exact length of the cable core. The number of threads used will be a function of the MBL to be achieved, taking into account the estimated efficiency for the cable in question.

The unit of accumulation of splice threads is the unit where threads used to assemble the two splices (positive and negative) are mounted and stored. The thread accumulator of the splices 51,52,53, hereafter referenced as accumulator, is formed by the vacuum drawdown grid 51, accumulator tubes of the self-assembly cells 52 and self-assembly grid of the splice threads 53.

Alternately, the set of positive splice threads 13 and the negative splice threads 13' may be accommodated in any support found in the state of the art. For example, the positive 13 and negative 13' splice threads could be stored in spools, frames, cages or any other support found in the state of the art. However, the level of organization thereof in these supports should be suited to the link of each thread to the address or position in the concentric circle of the cross section area of the cable.

In context of the present invention, thread accumulator tubes 52 attached to the self-assembly grid 53 are preferred. What is meant by thread accumulator tube 52 is a hard or flexible tube of suitable diameter and length, wherein one end is adapted to a certain eyelet 531 of the self-assembly grid 53 and the other end is adapted in a vacuum driven column in the vacuum drawdown grid 51. The vacuum drawdown grid 51 in turn, comprises electronic actuated valves coupled to a vacuum chamber, which open and close themselves, allowing for suction of the splice threads 13,13' into the tube 52. The column comprises a number of valves that can have the same number of eyelets present in the self-assembly column and the actuation thereof can be made by means of a software for industrial automation.

Using this type of device (tubes 52) to accumulate threads is possible because the splice thread segment is short as compared with the full length of the cable 2. The advantage of this device is to save a precious step of textile processing, where winding of thousands of segments of splice threads in spools would be necessary. It is important to note that these tubes 52 can not be found in the state of the art performing this function.

The unit of assembly of the splice threads in the core threads 21 is the unit where the core threads 21 are connected to the splice threads (positive and, then, negative), preferably using automatic devices which are in turn controlled by an industrial automation software.

Figure 5:
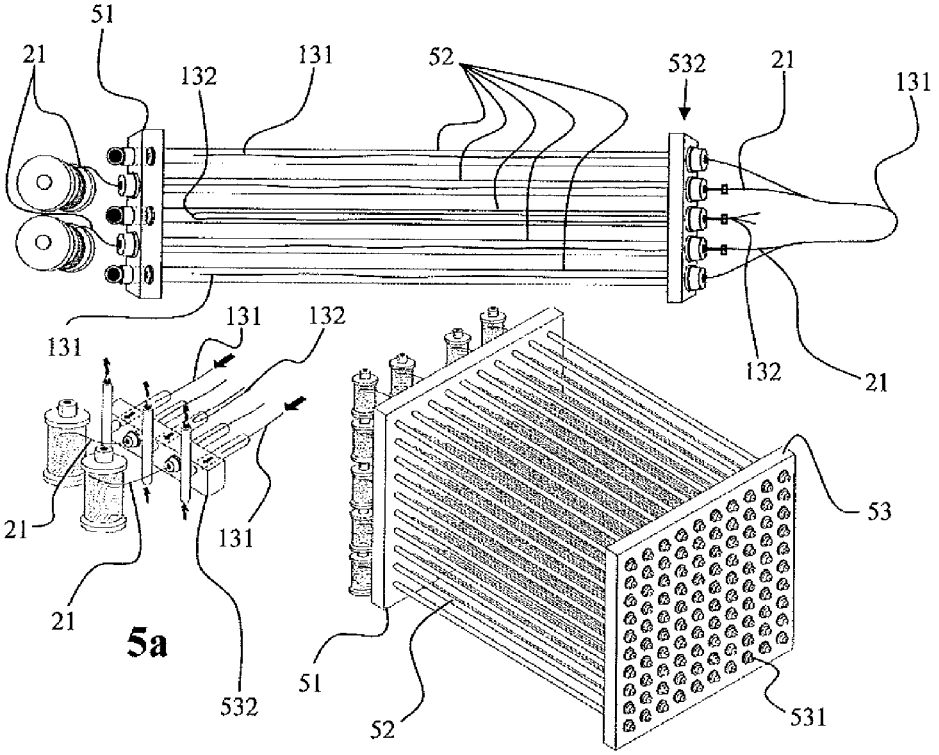
FIG. 5 illustrates a detail view of a self-assembly cell of the process of FIG. 4.

FIG. 5 illustrates a more detailed view of a production line of the optional configuration described so far (40,51,52,53), wherein one can note that the self-assembly frame 53 comprises several self-assembly cells 532. Each one of these cells 532 comprises:

two hollow tubes 52 through which the core threads 21 pass;

two tubes 52 connected to the suction grid 51 through which the ends of the positive splice thread 13 is drawn; and a tube 52, also connected to the suction grid 51, through which the thread of the negative splice 13' is drawn, such that the ends of the negative splice thread 13' are positioned outwardly from the self-assembly grid 53.

In these tubes 52, ceramic eyelets can be adapted to the ends to aid in reducing the friction between the thread and the contact points that can damage the threads. Core threads coming from the unit of storage of core threads 21 are pulled by any device for passing threads used in the textile industry via accumulator B and are mounted to the splice threads by means of a robotic head, which will be better described below.

Preferably, passing the core threads 21 is made by vacuum drawdown by way of a vacuum actuating device present in the robotic head.

It is important to note that each leg of the positive splice thread 13 is symmetrically mounted onto the more external tubes 52 of the self-assembly cell 532, such that positive splice threads 13 can be pulled to begin the self-assembly process. In turn, the negative splice threads 13' are mounted onto the center tube 52 of the cell 532 inversely to the positive splice thread 13. In such center tube the thread is drawn down by the vacuum system such that both of its legs are outside of the self-assembly grid 53.

Figure 6A:
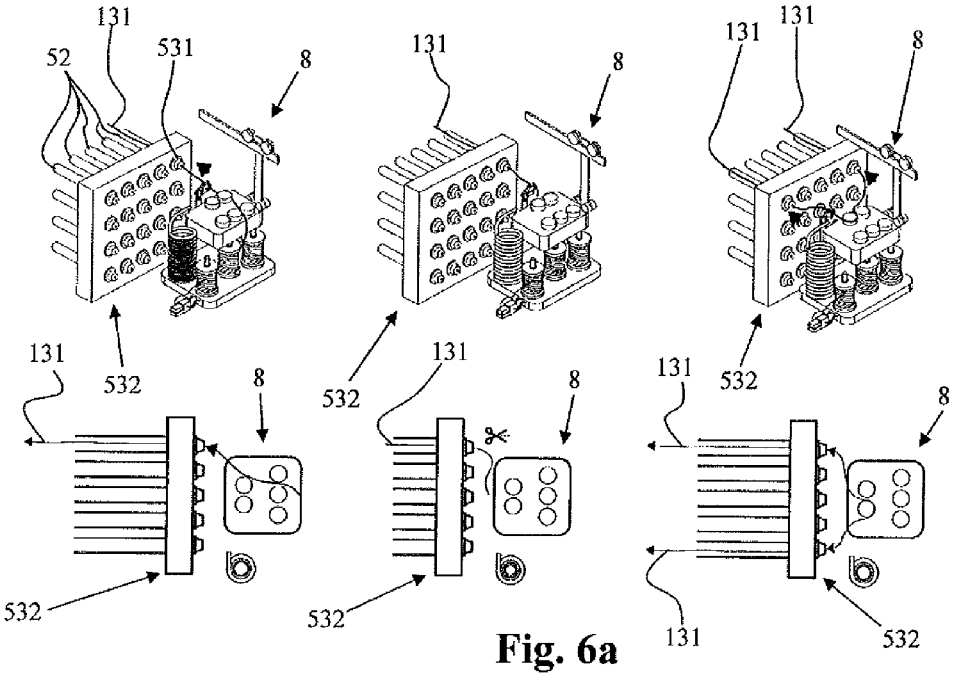
FIG. 6*a* illustrates a step-by-step schematic of how the threads of a positive splice are passed in the self-assembly cell of FIG. 4.

FIG. 6*a* illustrates a perspective view and a top view, step by step, of how the positive splice threads 13 are passed into a self-assembly cell 532. As can be seen in this optional embodiment, this process uses an automated head 8 that performs all procedures required for the preparation of the cells, prior to the beginning of the manufacture of the cable and/or splices. Firstly, one end of a thread splice is placed on an eyelet of the self-assembly cell 532 and drawn down into the an accumulator tube 52 (due to the vacuum system). In this tube 52, the thread is sucked until the entire length required for the splice to be manufacture is measured, then the head 8 uses a tweezer 81 to secure the thread which is then cut. At this point, the positive splice thread 13 is completely inside the accumulator tube 532 except for the second end that is secured by the tweezer 81. Then, this second end is taken to a second eyelet 531 of the self-assembly cell, such that this end is drawn by the tube 532 connected to said eyelet until both tubes comprise the same thread length in its interior, such that the center region of this thread is left out.

Figure 6B:
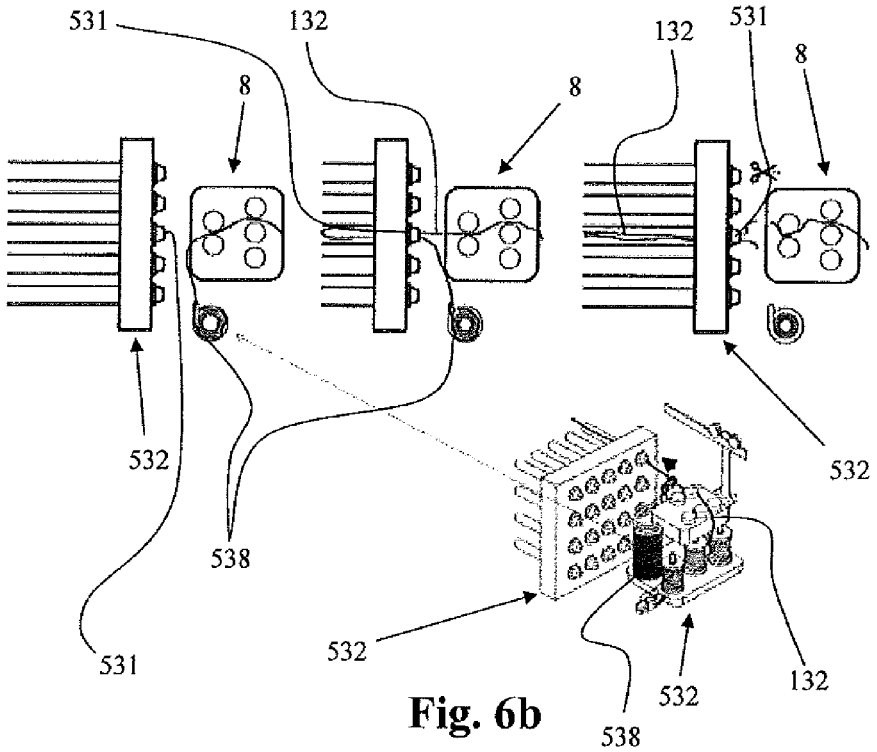
FIG. 6*b* illustrates a step-by-step schematic of how to pass the threads of a negative splice in a self-assembly cell of FIG. 4.

FIG. 6*b* illustrates a perspective view and a top view, step by step, of how the negative splice threads 13' are passed, which is also automated. The procedure involves the suction of a thread 13' segment into an auxiliary accumulator tube 538 contained inside the robotic head 8, such that this segment has the full length of the splice in said cell 532. Then, a loop (formed in the midpoint of the thread) is inserted into a center eyelet 531 of the self-assembly cell 532 and is drawn into its interior, such that only the ends of the thread 13' are left out. The thread 13' coming from the support of the robotic head is cut and the two tips of the negative splice thread are adapted to their respective supports.

After this procedure, the self-assembly cell will be configured to proceed with the production process of the cable, as illustrated by FIG. 4. When all the cells are duly configured, the manufacture process goes to the next step, wherein each core thread of the cable is connected to a leg of the positive splice. Thus, when the positive splice is pulled it brings with it the core threads 21.

Figure 7:
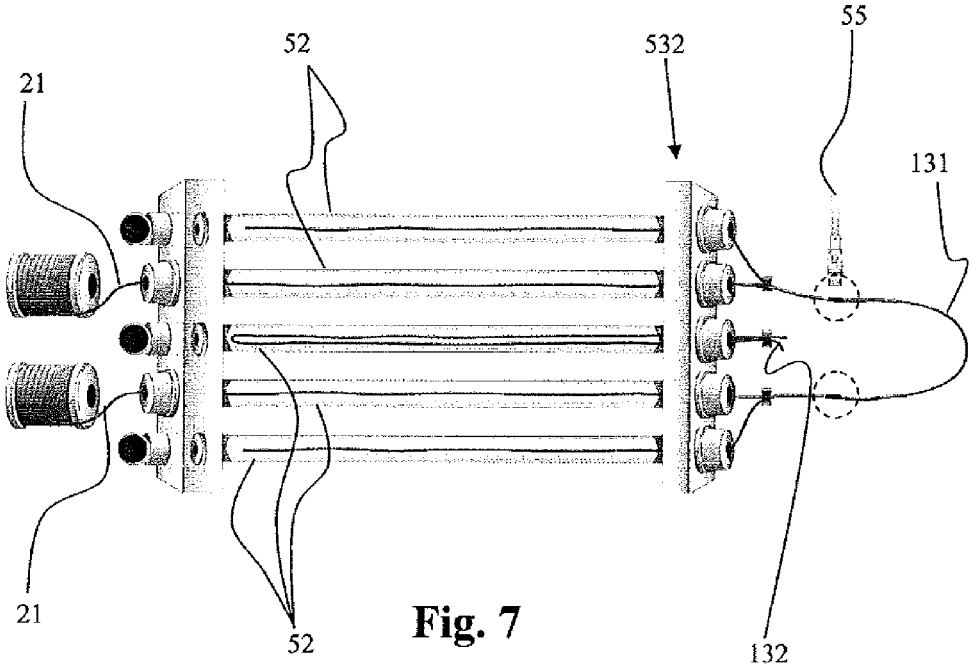
FIG. 7 illustrates a detail view of an alternative embodiment of a self-assembly cell of the process of FIG. 4.

Optionally, union of the core threads 21 and the splice threads is performed by means of splicers or knoters known in the art, which join the ends of the core threads 21 to the splice threads 13,13'. FIG. 7 illustrates an optional configuration of the aforementioned process, wherein a splicer 55 attaches the core threads 21 of the cable to a positive splice thread.

Determining the length of the unit of accumulators B as a function of the length of the tubes of the self-assembly cells will depend upon variables such as the static friction coefficient between the core threads 21 and the splice threads 13,13', the compression force given by the external tightening threads, the breaking strength of the points connecting the core threads 21 with the splice threads, the presence or not of coatings to increase the static friction coefficient between the threads contacting the interpenetration region and the use or not of winding devices for the splice threads 13,13' to the core thread in such a self-assembly region.

These winding devices of the splice threads 13,13' to the core threads 21 can be any mechanisms known from the state of the art that can be adapted on the front of each self-assembly cell. Controlling the RPM (rotations per meter) of this device is related to the forward speed of the cable, ensuring that the same helix angle is maintained over the entire construction of the splices. The sense of rotation of the device can be switched in relation to the address of the concentric layer of the splice segment. It enables one to switch the direction of winding between "S" and Z.

FIG. 5*a* illustrates a view of the detail shown in FIG. 5, wherein it can be seen that the accumulator tubes are adapted to the vacuum drawdown grid in manifolds that join the cells of the same column. At the top or bottom of the vacuum drawdown grid, a set of valves connected to a vacuum reservoir open and close themselves by industrial automation commands, which also control the operation of the robot head during the assembly operation of threads on the self-assembly grid.

The self-assembly cells are stacked in the shape of columns, such that union of these columns forms the self-assembly grid. The number of cells ranges in accordance with the maximum number of threads forming the core of the cable. For example, if the object is to build cables having a maximum number of 40,000 threads, it will be necessary to mount columns having 20,000 self-assembly cells. It will result in a self-assembly frame comprising 142 lanes containing 142 cells each. When cables of lower MBL are manufactured, the required number of threads will be mounted and the further assembly cells will not participate of the cable construction operation.

Assembly of the threads into the self-assembly grid is made by means of an automated head that travels the grid, cell by cell, mounting each of the core threads 21, the positive splice threads and in the end of the process, the negative splice threads. The head devices work concomitantly with the aperture suction valves of the vacuum threads. Thus, the threads of the splice are mounted and stored into the manifolds of the accumulators, adapted to their respective eyelets of each cell. The head meets the routines programmed in the industrial automation software, releasing, pulling and cutting the threads with precise length control. At the end of each assembly operation, tweezers connect the threads of the negative splices to the mounting support 533, where splicers or knoters will make the connection to the core threads 21, in due time, which will depend on the position and the length of each negative splice in the step of construction of the last termination.

The self-assembly grid still relies on the splicer or knoter heads, which travel each tower performing the operation of tightening or connecting the splice threads 13,13' to the core threads 21. At the beginning of the process for producing the cable, only the positive splice threads 13 are connected to the core threads 21. When all the threads of the positive splices are duly fixed to the respective core threads 21, the positive splice threads 13 pull the core threads.

In contrast, at the end of the process, threads of negative splices 13' are attached to the respective core threads 21 and are pulled by the core threads 21. Actuation of the splicers is made automatically by the industrial automation software, respecting the lengths of the legs of the splice threads that will determine the geometry of the interpenetration regions and ascending and descending interpenetration regions.

Again, with respect to FIG. 4, following the self-assembly grid 53 there is a hole plate 60. The hole plate 60 comprises a number of eyelets 61 that is equal to the total number of self-assembly cells 532, that is, through each eyelet 61 a positive 13 and a negative splice thread 13' (with both legs), and two core threads 21 are passed.

Figure 8:
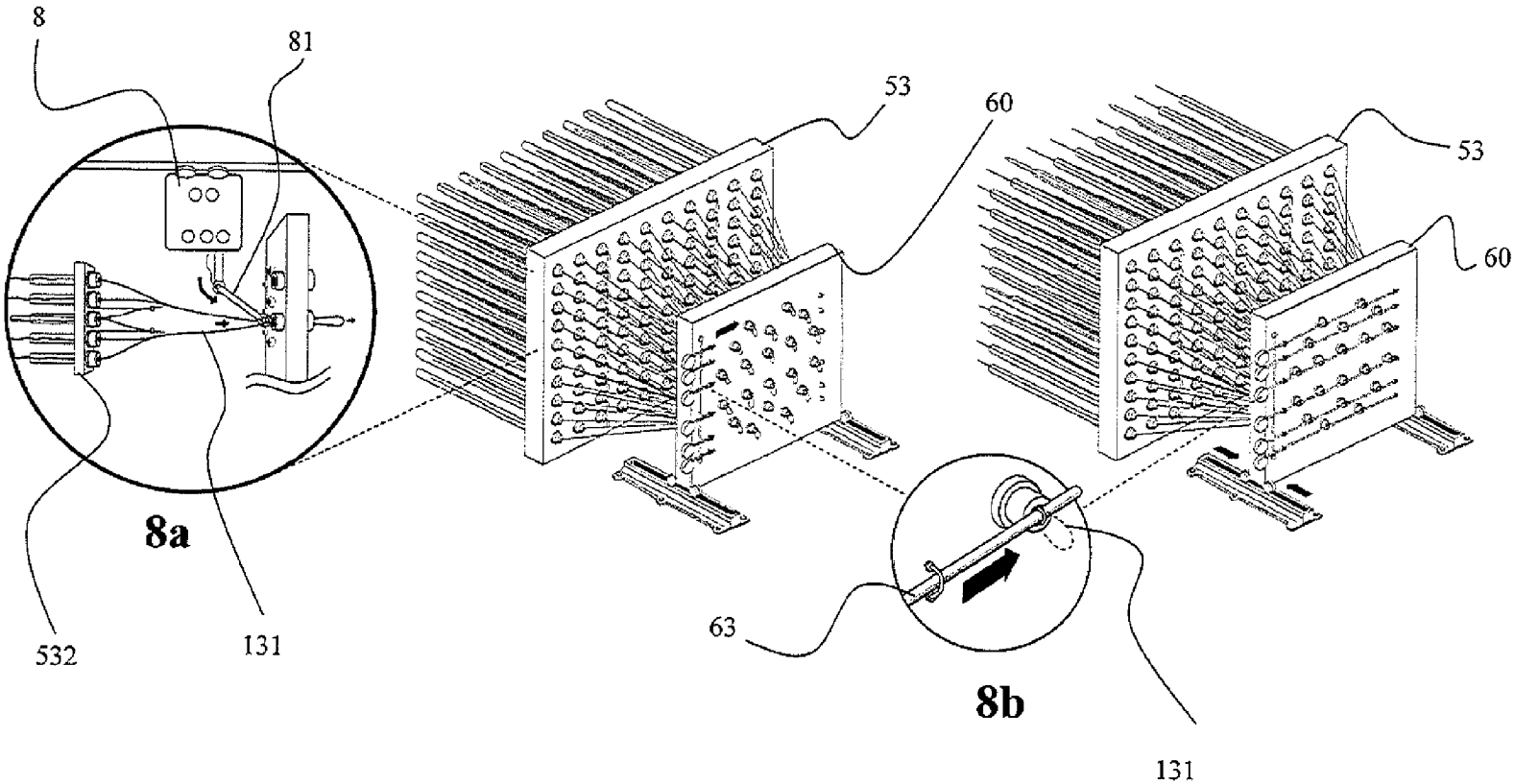
FIG. 8*a* illustrates a detail view of an optional embodiment of a hole plate of the present invention.

FIG. 8 illustrates this step of the described process, wherein after attachment of the positive splice threads 13 to the respective core threads 21, the automated head 8 inserts each positive splice thread 13 from a self-assembly cell 532 into an eyelet 61 of the hole plate 60 (detail 8*a*). After this step, a loop of the positive splice thread 13 is exposed at the external portion of the hole plate 60, then an attachment means is used to attach loops of all threads of the splices, preventing the same from being accidentally inserted into the holes.

Figure 9:
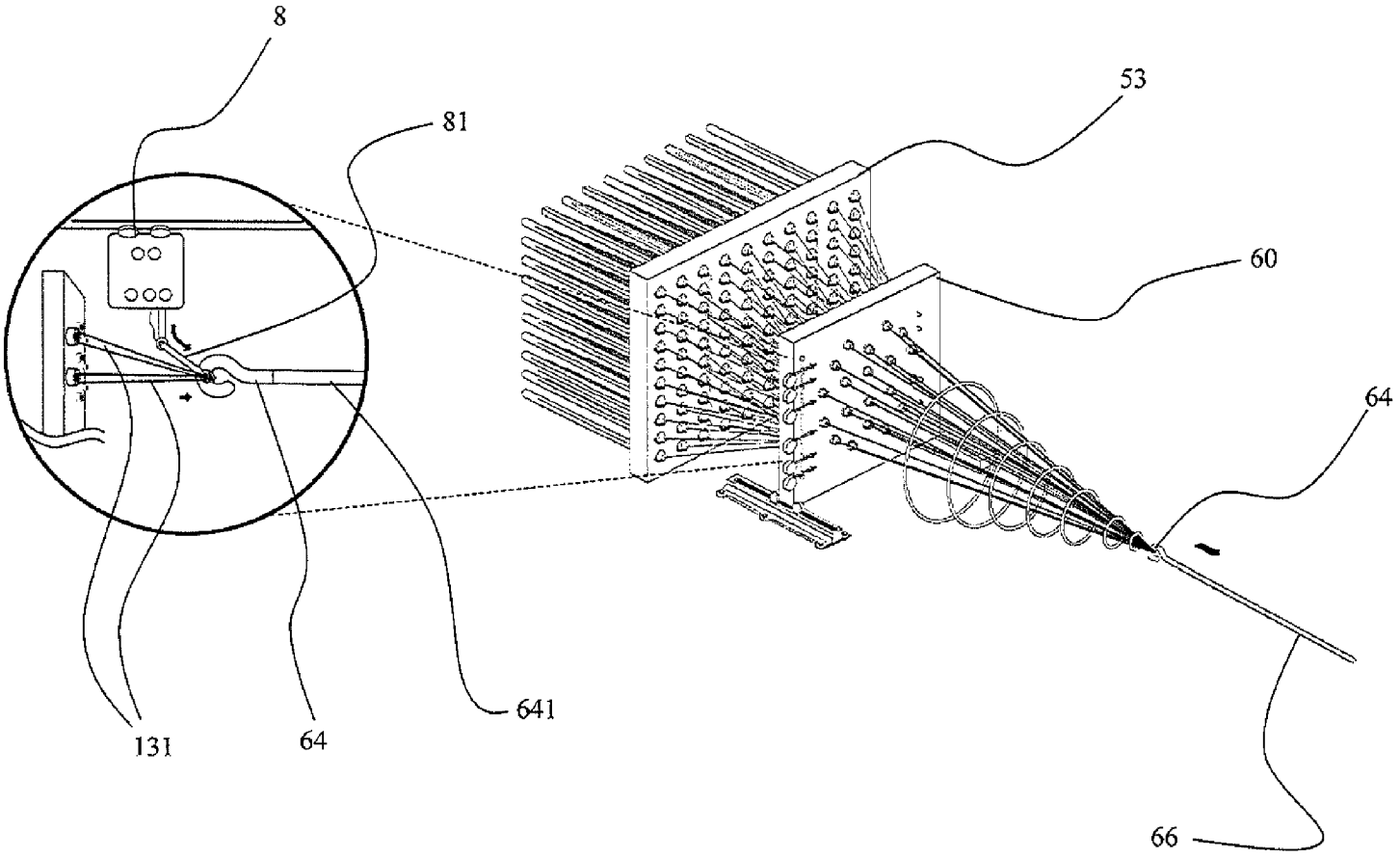
FIG. 9 illustrates a detail view of an optional embodiment of a hole plate of the present invention.

Preferably, as shown in the detail 8*b*, the attachment means is a flexible rod 63 that travels lines crossing the holes 61 and is used to attach the loops. More preferably, the flexible rod 63 is movable and is displaced through the linear path as shown in FIG. 9, attaching the loops formed by the positive splice threads 13 so as to attach them to the plate 60.

The described hole plate 60 comprises two main functions: the first function is to provide the cylindrical shape to the bundle of threads coming from the self-assembly grid; and the second function is to confer an address to each splice coming from the respective cell, so that each layer of the cable has an appropriate interpenetration length of the splice threads 13,13' with the core threads 21. As described above, this is a basic question for one to obtain an ideal architecture that directly affects efficiency of the cable 2.

In turn, the flexible rod 63 also acts to attach the loops to the hole plate 60. The flexible rod 63 moves by means of mechanisms actuated by stepper motors, also actuated by the industrial automation system that works concomitantly to the assembly motions of the automated head 8. The rod 63 has to be moveable for two reasons: first, the hole 61 has to be unobstructed for the loop to pass; and for the operation of passing the threads of the hole plate 60 to the mounting hook 64 of the eyelets 61, release of the loops takes place thread by thread from the centerline to the ends of the plate.

Optionally, the hole plate 60 is adapted on top of a moveable rail, whose movement is also controlled by the industrial automation system. It enables the plate 60 to move during the step of the assembly of the positive splices 13, exposing the loops of the positive splice threads 13 to the mounting hook 64 of the eyelets 11. In the context of the invention, the mounting hook 64 is characterized by being a metallic part in the form of a hook in which the operator traverses each line of the hole plate 60, and engages each one of the loops formed by the positive splice threads 13.

In context of the present invention, optionally, the starter cable 66 is characterized by being any flexible steel cable that supports the tensile force given by the sum of all friction between the threads of the bundle of the cable of the assembly unit.

Optionally, the starter cable pulls the total bundle of threads passing through diameter reducing rings 65, until the threads achieve an acceptable compression level and until the bundle achieves the approximate diameter of its nominal diameter.

Returning to FIG. 4, in the assembly unit of the reinforcing and cover members of the splices, the bundle of threads is still pulled until the segment of the cable containing the interpenetration region can be introduced into a binding machine 90, which has the function of winding the external tightening threads 30. Once the entire initial segment of the cable formed by the interpenetration region is reinforced by the external tightening thread, the starter cable pulling unit is terminated.

At that time, the segment is adjusted onto the mounting table 91 of the splice cover for all the reinforcing layers can be mounted therein. After this step, the first splice is mounted and protected.

Figure 10:
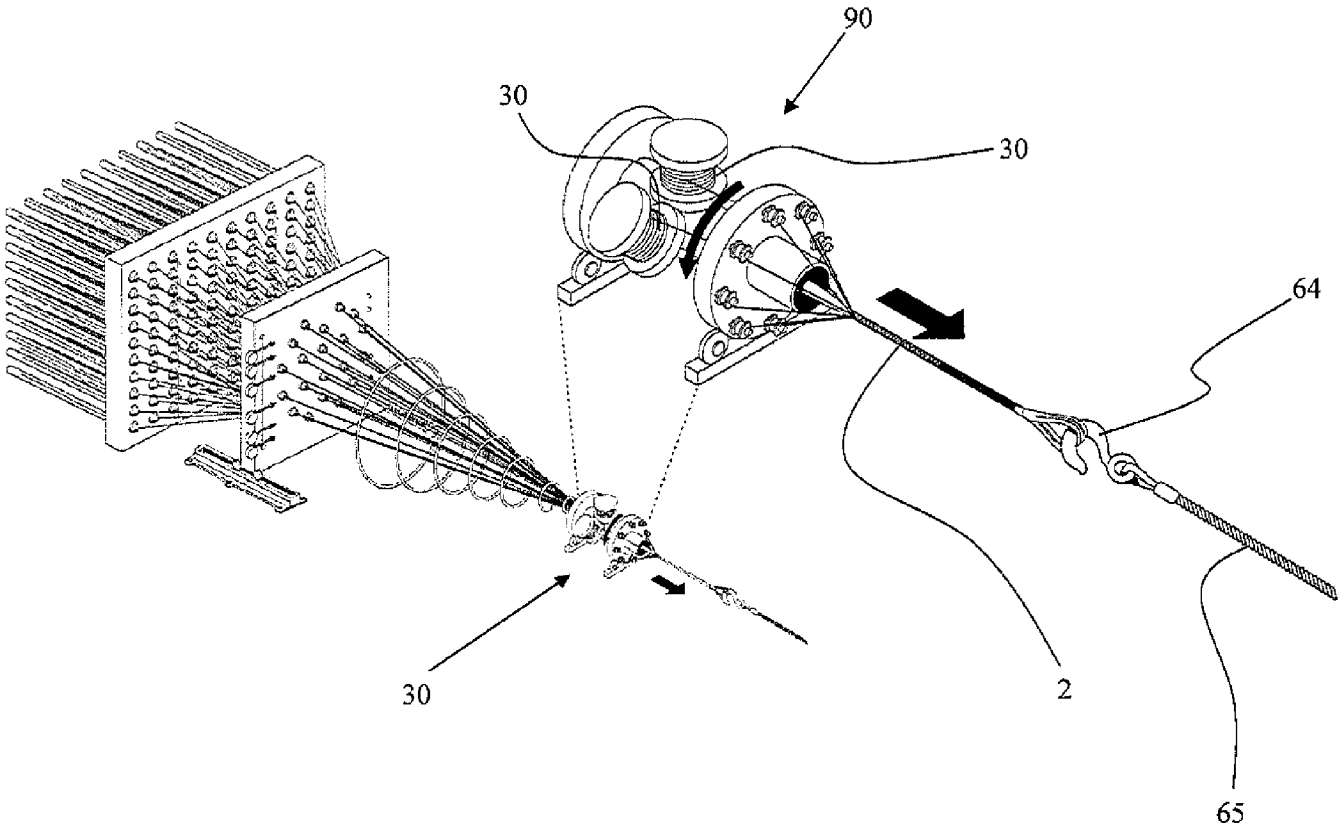
FIG. 10 illustrates a detail view of an optional embodiment of the process of tightening the cable of the present invention.

From this moment, the first splice can be pulled by the starter cable once again until the core segment can start receiving the external tightening threads. FIG. 10 illustrates the starter cable pulling cable 2 after receiving all the reinforcing layers at the eyelets region and at the interpenetration region (positive splice). The external tightening threads are wound by the binding machine, while rotation thereof is associated with the speed of motion of the cable.

Once an appropriate length of the core segment has been reinforced by the external tightening threads, the cable will optionally start to pass through the pull extrusion unit 92, which in turn acts to manufacture the extruded cover 921, which is intended to protect the entire body of the cable 2. It is important to note that the cover production unit 921 as described by the present invention can alternatively comprise any type of cover for cables, as found in the state of the art.

Any resin usually found in the state of the art can be used to manufacture the cover by pull extrusion. However, the melting temperature of such resin should be suited to the thermal characteristics of the thread used in the structural elements, that is, core threads and external tightening threads. Other features such as adhesion and good mechanical properties, such as abrasion resistance, perforation resistance, resistance to ultraviolet light, should be taken into account when choosing the resin. Some other properties such as resistance to hydrolysis, microorganisms and other sea agents should be considered when the application is related to offshore anchorage.

With the aid of pulling units or capstans 93, the cable segment coming from the pull extrusion unit 92 is pulled interruptedly until the end of the course of the core threads actuates the connection of the first segments of negative splice threads. At that moment, the production line can optionally enter in low speed stage for the motion heads of the splicers or knoters be able to travel the self-assembly columns connecting the negative splice threads 13' to the core threads, as described above for positive splices.

At that moment, the interpenetration region binding the cable body in the last (negative) splice starts to be mounted. Symmetrically to the beginning end, connections take place such that the different lengths of negative splice threads are mounted onto their respective layers, such that all the threads of the splices have the same final length.

Construction of the negative splice also involves assembly of the external tightening threads and any additional reinforcement that confers the required resistance to the interpenetration regions. It takes place continuously until all the threads of the negative splices are locked at the hole plate, where the flexible rod locks again the thread having the shape of a loop. However, at this moment, these loops will be on the opposite side of the loops of the positive splice threads 13, as shown in FIG. 8*b*.

In this step, pulling motion of the cable is made manually such that the threads do not force the hole plate 60. Next, the positive splice threads 13 are transferred from the hole plate 60 to the mounting hook 64 of the eyelets 11, wherein, a cable 66 referenced as to herein as starter cable, is used in the process.

In context of the present invention, the starter cable is a segment of a flexible steel cable that holds the tensile force required to maintain a suitable stretching of the last portion of the cable (last termination formed by the negative splice threads). The starter cable is adapted to an unwinding mechanism having controlled tensile force, which is retrofitted to the geometric center of the hole plate 60. After passing all the loops of the negative splice threads 13' to the mounting hook, the operator connects the finishing cable to the hook 64.

At this moment, the motor of the mechanism for unwinding the finishing cable is actuated and a counter-force maintains the cable stretched at the same level of tensile force as used to assemble the positive splice by the starter cable. With the threads arranged on the hook, the negative splice can be adjusted on the mounting table of the protective cover, where it will receive all the necessary reinforcement layers. After this operation, the cable is ready and can be wound.

Finally, the winding unit is basically formed of the capstan 93 and the winding machine 94. The capstan 93 is intended to confer the suitable pulling speed for the production of the cable 2. Actuation thereof and speed control may also be related to the industrial automation system.

The winding machine in turn accommodates the cable being produced by any winding tension control mechanism found in the state of the art. Such a mechanism is usually adapted between the cable segment coming from the capstan and the segment of the wound cable. The termination formed by the positive splice threads 13 is duly stored and protected in the spool. Any machine commonly used to that end and which has been disclosed in the state of the art can be used. After the last terminal receives the reinforcing layers and the protective cover, the cable is finally wound and can receive an exterior package for extra protection until use.

Therefore, the present invention further discloses a process for the production of a cable, wherein the production step is carried out in five units composing such a production line, comprising the following steps:

a) Assembling the core threads into the storage unit A of the core threads.

b) Assembling the spools of the splice thread onto the support that feeds the robotic head 8.

c) Actuating the assembly of the threads onto the self-assembly cells 532 or loading the self-assembly grid 53 of the splices, where the threads of a positive splice 13 are mounted on the cell 532 while the core threads 21 are pulled and connected to them by means of splicer or knoter devices.

(d) Assembling the negative splice threads 13' onto the self-assembly cells 532 and attaching both ends thereof to the cell support, concomitantly with operation (c).

(e) Passing and locking the positive splice threads to the hole plate 60.

(f) Transferring the positive splice threads 13 to the mounting hook 64 of the eyelets 11.

(g) Pulling the mounting hook by the starter cable 66 until the entire interpenetration region 12 is on the equipment that applies the external tightening threads 30.

(h) Actuating the machine that applies the external tightening threads 30.

(i) Stop pulling until the entire region containing the eyelet 11 and the interpenetration segment 12 is on the mounting table of the reinforcing layers 32 and the splices cover.

(j) Assembling the reinforcing layers and the cover at the eyelet region 11 and the splice interpenetration segment 12.

(l) Fitting the start of the bundle of the core to the pull extrusion matrix.

(m) Manufacturing the cable body until the beginning of the interpenetration region 12 of the negative splice threads 13', where capstan 93 reduces the speed thereof for the connecting points of negative splice threads 13' be connected to the bundle of core threads 21 by means of splicer or knoter devices, in an automatic manner, and controlled by the industrial automation system.

(n) Stop pulling when all the negative splice threads 13' are close to the hole plate 60, where a manual intervention will fit the loops of the negative splice threads 13' into the latches of the hole plate 60.

(o) Transferring the negative splice threads 13' to the mounting hook 64 of the eyelets 11.

(p) Finishing the cable, coating the terminal region with the reinforcing layers 32 and the cover.

Also, the present invention provides the possibility of joining more than one cable, as that disclosed herein, such that each cable is a segment of a larger cable. To that end, any mechanical joining device has to be coupled to the eyelets of two consecutive cables, linking them. It can be used in cases where a very long cable is required, whose manufacture in a single process is too laborious. This, one can manufacture smaller cable segments and join them using mechanical joining devices.

What is claimed is:

1. A synthetic cable comprising a core formed by high modulus threads arranged in parallel to each other, wherein the ends of the cable comprise splice-type termination ends, wherein each splice comprises high modulus threads arranged in parallel to each other forming an eyelet in each splice, characterized in that each leg of the threads comprising each splice is connected to a thread comprising the core of the cable, wherein the splice threads and the core threads are arranged in parallel to each other in a interpenetration region.

2. The cable of claim 1, characterized by comprising a means for application of a normal compression force at the interpenetration region, wherein the means for application of a normal compression force is selected from the group consisting of external tightening threads; tightening ribbons; and tightening screens.

3. The cable of claim 1, characterized in that each eyelet comprises a thimble protector against wearing.

4. The cable of claim 2, characterized in that the splice comprises, at the interpenetration region, at least one of a surface finishing liquid; and an adhesive.

5. A method for manufacturing a synthetic cable comprising a core made of high modulus threads arranged in parallel to each other, wherein the ends of the cable comprise splice-type termination ends, wherein each splice comprises high modulus threads arranged in parallel to each other, characterized by comprising the steps of:

individually connecting each leg of the wires comprising a positive splice to a thread of the beginning end of the cable core, forming a loop;

joining the threads of the positive splice so as to form a loop, straining all the threads, wherein the splice threads and the core threads are arranged in parallel to each other at an interpenetration region;

applying a normal compression force at the interpenetration region of the positive splice;

applying at least one protective element over the entire length of the cable;

individually connecting each leg of the threads that form a negative splice to a thread of the final end of the cable core, forming a loop;

joining the threads of the positive splice so as to form a loop, straining all the threads, wherein threads from the splice and threads from the core are arranged in parallel to each other at an interpenetration region; and applying a normal compression force at the interpenetration region of the negative splice.

6. The method for manufacturing a synthetic cable of claim 5, characterized in that the threads of the positive and negative splices are connected to the threads of the core by means of one of splicers and knoters.

7. The method for manufacturing a synthetic cable of claim 5, characterized in that the cable further passes through a pull extrusion process.

8. The method for manufacturing a synthetic cable of claim 5, characterized in that the splices are further coated with reinforcing layers and a cover.

9. The method for manufacturing a synthetic cable of claim 5, characterized in that the splice threads are stored in accumulator tubes connected to a suction grid, such that connection between the core threads and the splice threads is made by an automated head.

10. The method for manufacturing a synthetic cable of claim 5, characterized in that:

after the connection between the positive splice threads and the core threads, all the loops of the positive splice are arranged in a hook that is pulled by a flexible cable, such that the core threads are pulled by the positive splice threads;

after the connection between the negative splice threads and the core threads, such that the negative splice threads are pulled by the core threads, wherein all the loops of the negative splice are arranged in a second hook, which is stretched against the movement direction of the first hook to maintain the cable stretched.

11. The method for manufacturing a synthetic cable of claim 10, characterized in that before the positive splice threads are arranged in the first hook, each loop formed by the positive splice threads is arranged in holes of a hole plate, such that the holes are arranged at positions where the threads should be allocated at the core of the cable.

12. The method for manufacturing a synthetic cable of claim 11, characterized in that after passing through the hole plate, the splice loops and the core threads of the cable pass through diameter reducing rings, until the normal compression force is applied to the interpenetration region of the positive splice and, thereafter, the at least one protective element over the entire length of the cable.

* * * * *